United States Patent [19]

Martin

[11] Patent Number: 4,964,527

[45] Date of Patent: Oct. 23, 1990

[54] PAINT SAVER AND CAN SEAL PROTECTOR

[76] Inventor: Harry W. Martin, 307 S. Smith Ave., #59, Corona, Calif. 91720

[21] Appl. No.: 451,592

[22] Filed: Dec. 18, 1989

[51] Int. Cl.[5] ..... B65D 25/48

[52] U.S. Cl. ..... 220/90; 220/4 A

[58] Field of Search ..... 220/4 A, 90

[56] References Cited

U.S. PATENT DOCUMENTS

| | | | |
|---|---|---|---|
| 2,124,021 | 7/1938 | Akers | 220/90 |
| 2,756,899 | 7/1956 | Crandall | 220/90 |
| 2,873,052 | 2/1959 | Atherton | 220/90 |
| 2,873,881 | 2/1959 | Nichols | 220/4 A |
| 3,273,746 | 9/1966 | Andrews | 220/90 |
| 3,469,735 | 9/1969 | Burt | 220/90 |
| 3,744,671 | 7/1973 | Saunders | 220/4 A |
| 3,899,107 | 8/1975 | Gaal | 220/90 |
| 4,020,968 | 5/1977 | Chiavola | 220/90 |
| 4,369,890 | 1/1983 | Bennett | 220/4 A |
| 4,583,666 | 4/1986 | Buck | 220/90 |

FOREIGN PATENT DOCUMENTS

| | | | |
|---|---|---|---|
| 930271 | 7/1963 | United Kingdom | 220/90 |

*Primary Examiner*—Stephen Marcus
*Assistant Examiner*—S. Castellano

[57] ABSTRACT

A tool that prohibits excess paint from draining down onto the top of a paint can and then into the sealing groove, when the brush is wiped on top of the can. The tool is comprised of a round tube (10) with a vee trough (22) around the outside diameter (18). A series of rectangular holes (24) is incorporated around the inside of the vee trough (22) which allows the paint to drain back into the can. The tool incorporates a shoulder (20) and a tapered side (12) to locate said tool in the paint can.

1 Claim, 2 Drawing Sheets

PAINT SAVER AND CAN SEAL PROTECTOR

BACKGROUND

1. Field Of Invention

This invention relates to the broad field of devices and or tools used by both the professional and amateur painter.

2. Description Of Prior Art

Both professional and "do-it-yourselfers" extract paint directly from the can with a brush applicator. When wiping off excess paint on the inside edge of the can, some of the paint will flow back onto the top of the can and into the sealing groove. The paint will also run down the sides of the can making it slippery and hard to hold. A lot of paint is thereby lost during the cleaning process.

No instrument has been found that specifically addresses these two conditions. However, three items were found, two in a paint store and one in a grocery store, that might be remotely related. One is a molded plactic ring that inserts in one-gallon cans inside the opening of the can, and is used to pour paint from the can into a roller tray, or another container. It does not protect the sealing groove, or direct the paint back into the can as our invention does.

The second item is a short plastic strip that locates in the sealing groove and supports the brush when it is laid down on top of the can. It has no other function.

The third item is the pouring spout used in the top of liquid detergent containers such as the two gallon size of "Tide." It consists of a cone shaped plastic extrusion with an open slot down the side, and a flat bottom incorporating an angle. The sealing cap for the container is also used to measure a given amount of the contents. When the cap is screwed back on, any residue left inside drains back into the container. This unit does not lend itself to repeated dipping of a brush to remove the contents.

Most painters would find our invention a useful tool, especially when painting over a long period of time, and when holding the can by the bail while standing on a ladder.

OBJECTS AND ADVANTAGES

In view of the above we claim the following as our objects and advantages of the invention: to provide an inexpensive tool for protection of the sealing groove for resealing the can, to prevent the paint from flowing down the sides of the can, and the saving of paint lost through the cleaning process.

In addition, we claim the configuration of the vee trough and holes, can be adapted to fit any container shape such as square, oval, or rectangular where it is desireable to work as clean as possible, or to keep content loss to a minimum.

Readers will see the obvious advantages of the invention from consideration of the ensuing description and accompanying drawings.

DRAWING FIGURES

DRAWING REFERENCE NUMERALS

10 Tube
12 Tapered diameter to fit can opening.
14 Top outside diameter.
16 Edge for wiping brush.
18 Outside diameter of tool.
20 Locating shoulder.
22 Vee trough.
24 Drainage holes
26 Trough rib.

SINGLE-PIECE TOOL—DESCRIPTION

Figure 1:
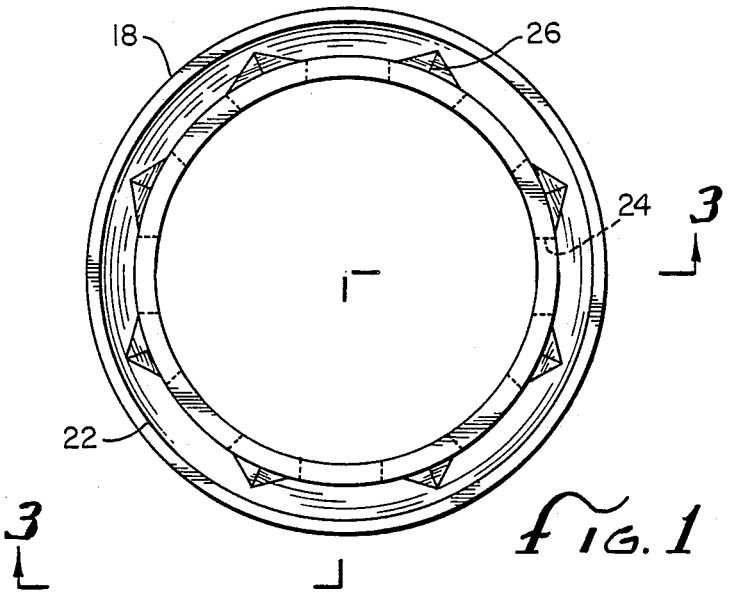
FIG. 1 shows a top view of the invention.
Figure 2:
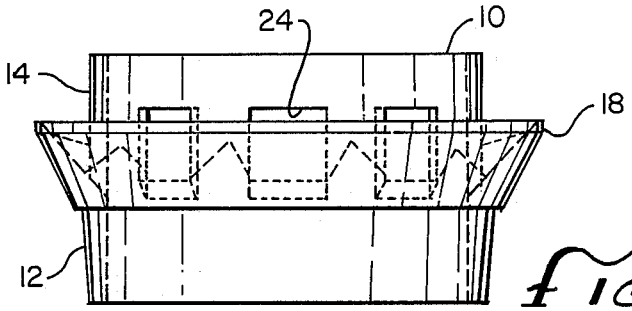
FIG. 2 shows a side view of such tool.
Figure 3:
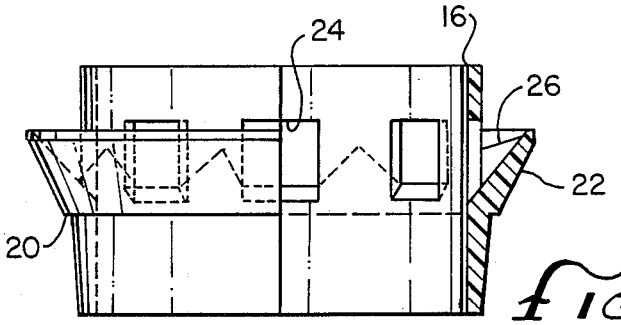
FIG. 3 shows a sectional side view along the line 3—3 of FIG. 1 of such tool. This view shows the vee trough, drainage hole, the angled rib, brush wiping edge and can fitting area.

FIGS. 1 and 2 show a single-piece tool according to the preferred embodiment of the invention. The tool is basically a round tube 10 with a vee shaped trough 22 around the outside diameter 18. A series of rectangular holes 24, evenly spaced around the inside wall 14 of the vee trough 22 are incorporated. The bottom end and outside diameter 20 of the tube is tapered to fit inside the opening of the paint can. At the bottom of the angled shaped trough 22 on the outside diameter, a shoulder 20 is provided to rest on top of the opening of the paint can. The outside diameter of the vee trough 22 is almost equal to the outside diameter of the paint can. It is large enough to protect the sealing groove in the paint can, but small enough to permit the bail to fold upright for carrying or holding purposes. The inside angle of the vee trough 22 from the outside diameter 18 to the bottom of the trough is 45°. The outside angle of the vee trough 22 from top to bottom is 37°. Inside the vee trough 22 around the diameter, a series of ribs 26 are incorporated that run from the inside lip of the trough to the outside diameter 14 of the top of the tool where the brush is wiped. These ribs 26 are angled down and outward from top to bottom and intersect the edge of the holes 24 at the bottom of the vee 22. The inside diameter of the tube 10 from top to bottom incorporates a 1° draft angle.

SINGLE-PIECE TOOL—OPERATION

The operation and use of the Paint Saver and Can Seal Protector is simple and straightforward. The FIG. 1 tool is inserted into the opening of the paint can and rests on a shoulder 20 and the taper 12 at the bottom of said tool. The taper 12 provides a close fit for stability of the can and tool combination, and allows for manufacturing tolerances of the opening in the can.

When the brush is dipped into the paint and wiped across the inside edge 16 of said tool to remove excess paint, the excess paint that would ordinarily flow onto the top of the can and into the sealing groove, instead, flows down into the vee trough 22 around the diameter. As the paint flows down into the trough 22 the holes 24 around the inside of the trough 22 provide an opening for the paint to drain back into the can.

When finished, the tool is removed from the can, and in the case of water soluable paint, is easily cleaned for storage and future use. In practice it worked quite well.

While the above description contains several specifics, the reader should not construe these as limitations on the scope of the invention, but merely as examples of preferred embodiment thereof. Those skilled in the art will envision that other possible variations are within its scope. For example, skilled artisans will be able to change the dimensions and shapes of the various embodiments to fit other containers such as square, oval or rectangular shaped, and to fit different size containers such as pint, quart and gallon. They will also be able to make the tool from alternate materials such as steel, non-ferrous metals, austenetic metal, cement or plastic. Accordingly, the reader is requested to determine the scope of the invention by the appended claims and their legal equivalents and not by the noted examples.

I claim:

1. An accessory used with a container for catching excess liquid from an applicator, draining the liquid back into the container, and protecting a container sealing groove, said accessory comprising:

a one piece round tube providing a brush wiping edge at a top open end of said tube, a trough extending from an outside lip to a wall of said tube for catching excess liquid, a plurality of rectangular shaped holes extending through said wall of said tube adjacent to said trough, and evenly spaced around the diameter and extending below the top end of said tube, said holes providing an exit for the excess liquid to drain from the trough back into the container, a plurality of rib sections equally spaced inside and around said trough, and extending from said outside lip inward to said wall of said tube half-way between each of said plurality of rectangular holes, and angled downwardly to intersect with edges of said rectangular holes thereby accelerating the draining of excess liquid back into said container, and two interrelated surfaces to locate said accessory within said container.

* * * * *